US009603227B2

(12) United States Patent
Gyoten et al.

(10) Patent No.: US 9,603,227 B2
(45) Date of Patent: Mar. 21, 2017

(54) SEMICONDUCTOR LIGHT SOURCE DRIVING APPARATUS

(71) Applicant: Panasonic Intellectual Property Management Co., Ltd., Osaka (JP)

(72) Inventors: Takaaki Gyoten, Hyogo (JP); Shinji Miyoshi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/177,463

(22) Filed: Jun. 9, 2016

(65) Prior Publication Data

US 2016/0381773 A1 Dec. 29, 2016

(30) Foreign Application Priority Data

Jun. 23, 2015 (JP) ..... 2015-125206
May 30, 2016 (JP) ..... 2016-106942

(51) Int. Cl.
*H05B 37/02* (2006.01)
*H05B 37/03* (2006.01)

(52) U.S. Cl.
CPC ..... *H05B 37/036* (2013.01); *H05B 37/0209* (2013.01)

(58) Field of Classification Search
CPC ..... H05B 37/0209; H05B 37/036
USPC ..... 315/122
See application file for complete search history.

(56) References Cited

U.S. PATENT DOCUMENTS

2010/0060175 A1* 3/2010 Lethellier ..... H05B 33/0815 315/164
2011/0109228 A1* 5/2011 Shimomura ..... H05B 37/0245 315/113
2012/0313529 A1* 12/2012 Chen ..... H05B 33/0887 315/121
2013/0015781 A1* 1/2013 Kanemitsu ..... H05B 33/0815 315/291
2013/0313973 A1* 11/2013 DeNicholas ..... H05B 33/089 315/122

(Continued)

FOREIGN PATENT DOCUMENTS

JP 2009-302295 12/2009

*Primary Examiner* — Don Le
(74) *Attorney, Agent, or Firm* — McDermott will & Emery LLP

(57) ABSTRACT

The semiconductor light source driving apparatus includes light source modules, a current control element, a second current detection element, a DC power supply, and a controller. The light source modules each include the following components connected in parallel: a semiconductor light source; a first constant-voltage diode; a series circuit of a first current detection element and a second constant-voltage diode with a lower breakdown voltage than the first constant-voltage diode; and a switching element. The controller controls the DC power supply based on a detection output of the second current detection element. After the first current detection element generates a output in response to an open fault in any of the semiconductor light sources, and then the current control element is turned off, the controller turns on the switching element of the light source module with the open fault, thereby allowing the current control element to be controlled.

5 Claims, 2 Drawing Sheets

(56) References Cited

U.S. PATENT DOCUMENTS

| | | | | |
|---|---|---|---|---|
| 2015/0115816 | A1* | 4/2015 | Bradford | H05B 33/083 315/192 |
| 2016/0079865 | A1* | 3/2016 | Yamaji | H05B 33/0815 315/122 |
| 2016/0227616 | A1* | 8/2016 | Lee | H05B 33/0842 |
| 2016/0270167 | A1* | 9/2016 | Franck | H05B 33/0848 |

* cited by examiner

SEMICONDUCTOR LIGHT SOURCE DRIVING APPARATUS

BACKGROUND

Technical Field

The present disclosure relates to a semiconductor light source driving apparatus for controlling the illumination of semiconductor light source elements such as light emitting diodes and laser diodes.

Description of the Related Art

Patent Literature 1 discloses a light-emitting diode driver in which even if one or more of the serially-connected light emitting diodes are accidentally disconnected, the other diodes remain lit, and the disconnection is notified to the user.

CITATION LIST

Patent Literature

PTL 1: Japanese Unexamined Patent Application Publication No. 2009-302295

SUMMARY

An object of the present disclosure is to provide a semiconductor light source driving apparatus in which a constant voltage diode for voltage suppression with low continuous allowable power dissipation can be used to be connected between the two endmost semiconductor light source elements of each semiconductor light source.

The semiconductor light source driving apparatus of the present disclosure includes the following components: a plurality of light source modules; a current control element controlled by pulse-width modulation (PWM) using a PWM signal supplied to an end of the current control element; a second current detection element for detecting current flowing through the light source modules; a direct current (DC) power supply for supplying a DC voltage across a serial connection of the light source modules, the current control element, and the second current detection element; and a controller for controlling a switching element, the current control element, and the DC power supply. The light source modules each include the following components connected in parallel: a semiconductor light source composed of one or more serially-connected semiconductor light source elements; a first constant-voltage diode; a series circuit of a first current detection element and a second constant-voltage diode with a lower breakdown voltage than the first constant-voltage diode; and the switching element. The controller controls the output voltage of the DC power supply based on a detection output of the second current detection element. After the first current detection element generates a detection output in response to an occurrence of an open fault in any of the semiconductor light sources, and then the current control element is turned off based on the detection output of the first current detection element, the controller turns on the switching element of the light source module including the semiconductor light source with the open fault, thereby allowing the current control element to be controlled by the PWM.

In the semiconductor light source driving apparatus of the present disclosure, a constant voltage diode for voltage suppression with low continuous allowable power dissipation can be used to be connected between the two endmost semiconductor light source elements of each semiconductor light source.

DETAILED DESCRIPTION OF THE PREFERRED EMBODIMENTS

Figure 1:
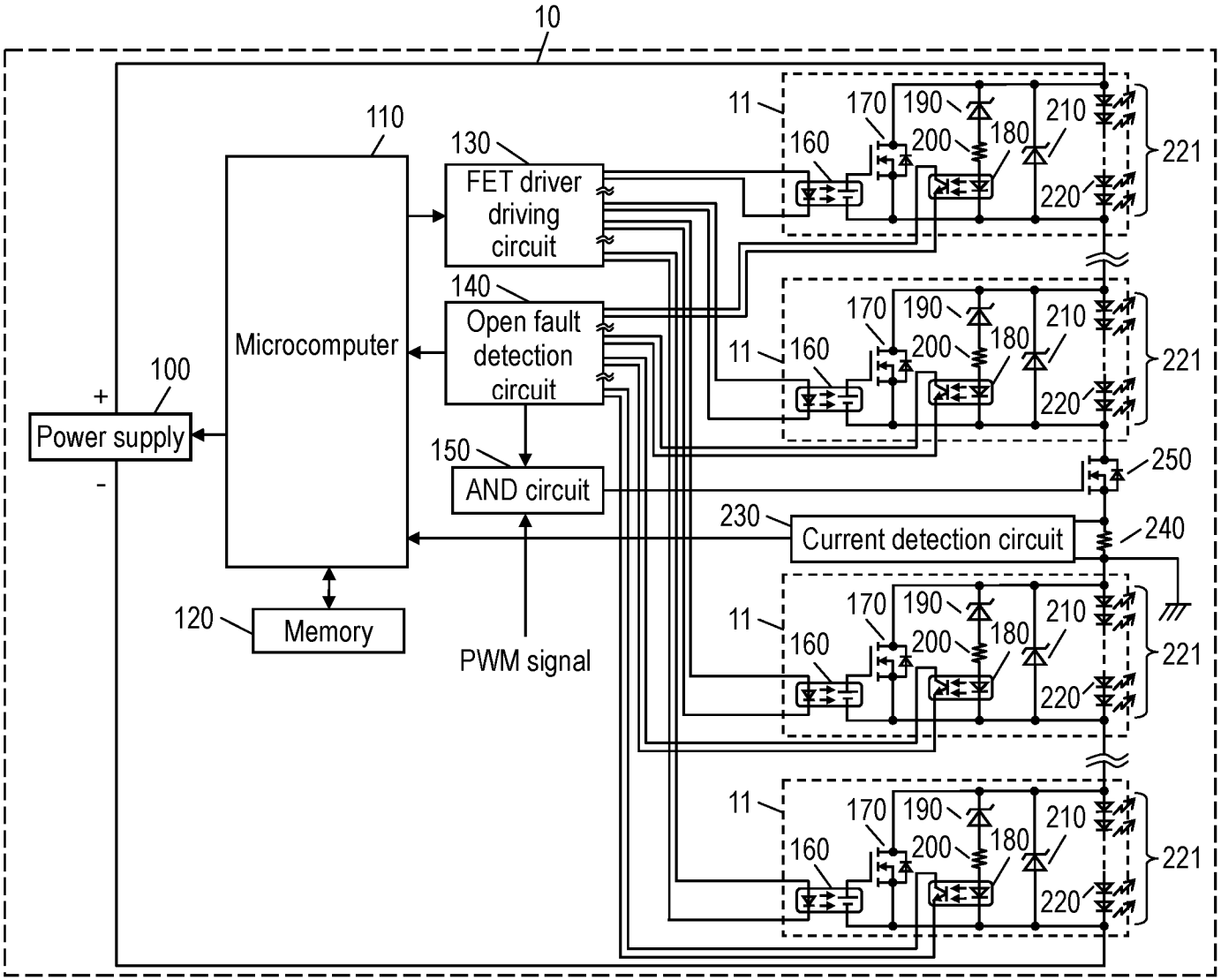
FIG. 1 is a circuit block diagram of a semiconductor light source driving apparatus according to a first exemplary embodiment.

Preferred embodiments will be described in detail as follows with reference to the accompanying drawings. However, in order to avoid redundancy and help those skilled in the art understand these embodiments, descriptions of well-known matters and substantially the same configuration as described earlier will be omitted.

Note that the attached drawings and the following description are provided to make those skilled in the art fully understand the present disclosure and are not intended to limit the subject of the claims.

The drawings are only schematic and the dimensional ratios are not the same as the actual ones. Therefore, actual dimensions should be determined by considering the following description. It goes without saying that the dimensional relations and ratios of some components may be different between these drawings.

First Exemplary Embodiment

A first exemplary embodiment will now be described with reference to FIG. 1.

[1-1] Configuration

First, semiconductor light source driving apparatus 10 of the first exemplary embodiment will now be described with reference to FIG. 1.

Semiconductor light source driving apparatus 10 includes DC power supply 100, microcontroller 110, memory 120, field-effect transistor (FET) driver driving circuit 130, open fault detection circuit 140, AND circuit 150, a plurality of light source modules 11, current detection circuit 230, current detection resistor 240, and n-channel FET 250.

N-channel FET 250, which on-off controls the current flowing through light source modules 11, is connected in series with light source modules 11 together with current detection resistor 240.

The voltage generated across current detection resistor 240 is supplied to current detection circuit 230, which in turn supplies its detection output to microcontroller 110. The connection point of current detection resistor 240 and light source modules 11 is grounded.

AND circuit 150 computes the AND of an incoming pulse-width modulation (PWM) signal with a signal from open fault detection circuit 140, and supplies its output to the gate of n-channel FET 250. The signal supplied from open fault detection circuit 140 to AND circuit 150 is a low-level signal in the case of an open fault and is a high-level signal in the normal condition.

DC power supply 100 supplies a DC voltage across the serial connection of light source modules 11, n-channel FET 250, and current detection resistor 240. The output DC voltage is controlled by microcontroller 110.

Memory 120 stores information to identify which of light source modules 11 has/have an open fault, if any.

Each light source module 11 includes semiconductor light source 221 composed of one or a predetermined number of serially-connected laser diodes 220. Semiconductor light source 221 is connected in parallel with constant voltage diode 210 for voltage suppression. Semiconductor light source 221 is further connected in parallel with a circuit composed of constant voltage diode 190 for voltage detection, resistor 200, and the light emitting diode (LED) of photo-coupler 180, all of which are connected in series. Photo-coupler 180 is used to transmit fault detection information.

Semiconductor light source 221 is further connected in parallel with the drain and source of n-channel FET 170. FET driver 160 is composed of an integrated combination of an LED and a photocell, and the photocell output terminals of FET driver 160 are connected between the gate and the source of n-channel FET 170.

The LED of FET driver 160 is driven by FET driver driving circuit 130. The output of photo-coupler 180 is supplied to open fault detection circuit 140.

In each exemplary embodiment of the present disclosure, the term "open fault" means that laser diodes 220 of each semiconductor light source 221 are accidentally disconnected, and is also called "disconnection fault".

Microcontroller 110 is an example of the controller. Laser diode 220 is an example of the semiconductor light source element. Constant voltage diode 210 for voltage suppression is an example of the first constant-voltage diode. Constant voltage diode 190 for voltage detection is an example of the second constant-voltage diode. Photo-coupler 180 for transmission of fault detection information is an example of the first current detection element. N-channel FET 170 is an example of the switching element. N-channel FET 250 is an example of the current control element. Current detection resistor 240 is an example of the second current detection element.

When, for example, six light source modules 11 are serially connected, one of them could be connected between current detection resistor 240 and the positive electrode of DC power supply 100 and the remaining five of them could be connected between current detection resistor 240 and the negative electrode of DC power supply 100.

In that case, however, the potential differences between light source modules 11 and each of microcontroller 110 and current detection circuit 230 connected to current detection resistor 240, would have the largest potential difference at endmost of light source module 11 connected to the negative electrode of DC power supply 100. This difference would be five times the potential difference of the light source module 11 connected to the positive electrode. This would undesirably increase the isolation voltage required between each semiconductor light source 221 and a member used to hold or cool it.

To avoid this problem, as shown in FIG. 1, in semiconductor light source driving apparatus 10 of the present exemplary embodiment, three light source modules 11 (one of them is not illustrated in FIG. 1) are connected between current detection resistor 240 and the positive electrode of DC power supply 100, whereas other three light source modules 11 (one of them is not illustrated in FIG. 1) are connected between current detection resistor 240 and the negative electrode of DC power supply 100. In short, it is preferable that the same or a similar number of light source modules 11 should be connected to both the positive and negative electrodes of DC power supply 100, thereby minimizing the voltage of each light source module 11.

[1-2] Operation

The operation of semiconductor light source driving apparatus 10 with the above structure will now be described with reference to FIG. 1.

When none of semiconductor light sources 221 has an open fault in all light source modules 11, microcontroller 110 controls DC power supply 100 so that an increasing voltage is applied to the series circuit of light source modules 11, current detection resistor 240, and n-channel FET 250. As a result, current starts to flow through the series circuit. Microcontroller 110 detects the current flowing through the series circuit by means of current detection resistor 240 and current detection circuit 230. Microcontroller 110 then controls the output voltage of DC power supply 100 so as to obtain a specified current value.

When none of semiconductor light sources 221 has an open fault, open fault detection circuit 140 supplies a high-level signal to AND circuit 150. This allows a PWM signal to be supplied to the gate of n-channel FET 250, thereby on-off controlling (PWM-controlling) n-channel FET 250. In other words, the average value of the current flowing through semiconductor light sources 221 is determined by the duty ratio of the PWM signal, which determines the amount of light obtained from semiconductor light source driving apparatus 10. Note that the PWM signal is generated by an unillustrated PWM signal generating circuit.

When any of semiconductor light sources 221 has an open fault, the light source module 11 including the semiconductor light source 221 with the open fault has a rapid increase in impedance. If constant voltage diode 210 for voltage suppression were absent, it would generate an output voltage of DC power supply 100 across the light source module 11 that includes the semiconductor light source 221 with the open fault.

In the present exemplary embodiment, however, constant voltage diode 210 for voltage suppression is provided to generate a voltage that is limited by the breakdown voltage of constant voltage diode 210.

The breakdown voltage of constant voltage diode 210 is set to a value obtained by adding a margin voltage to the maximum voltage of semiconductor light source 221 composed of the serially-connected laser diodes 220 when semiconductor light source 221 is in motion. The margin voltage is determined in consideration of voltage variations, such as the voltage variation when semiconductor light source 221 is in motion, the breakdown voltage variation of constant voltage diode 190 for voltage detection, and the forward voltage variation of the LED of photo-coupler 180.

If the margin voltage is high, n-channel FET 170 is required to have a high withstand voltage. If the margin voltage is low, the current flowing through the LED of photo-coupler 180 is too low to ensure the detection of open faults. Hence, the margin voltage is usually set to 10 V (volt) or so.

Furthermore, the breakdown voltage of constant voltage diode 210 limits the voltage of n-channel FET 170, so that n-channel FET 170 can have a withstand voltage as low as the sum of the operating voltage of semiconductor light source 221, a voltage of 10 V or so, and the margin voltage (the operating voltage of light source 221+a voltage of 10 V or so+the margin voltage). FETs with a low withstand voltage have a low on-resistance, and hence, the advantages of having a small loss during operation and being inexpensive.

The breakdown voltage of constant voltage diode 190 for voltage detection is set lower by several volts than that of constant voltage diode 210 for voltage suppression.

If an open fault occurs, the difference voltage between the breakdown voltages of constant voltage diodes 190 and 210 is applied to the series circuit of resistor 200 and the LED of photo-coupler 180. As a result, the phototransistor of photo-coupler 180 is turned on.

Upon detection of the turning on of photo-coupler 180, open fault detection circuit 140 informs microcontroller 110 of the information of the identified light source module 11 with an open fault. Open fault detection circuit 140 further supplies AND circuit 150 with a low-level signal to turn off n-channel FET 250.

Microcontroller 110 can grasp which of light source modules 11 has an open fault by the information from open fault detection circuit 140.

N-channel FET 250 is turned off if an open fault occurs, so that the output voltage of DC power supply 100 is concentrated on the drain and source of n-channel FET 250. This greatly reduces the current flowing through constant voltage diode 210 in light source module 11 with the open fault.

As a result, constant voltage diode 210 has high power dissipation only at the moment of the occurrence of an open fault. The power dissipation starts to decrease when open fault detection circuit 140 detects the open fault.

A constant voltage diode with low continuous allowable power dissipation can be used as constant voltage diode 210 because its short-time allowable power dissipation is about 100 times its continuous allowable power dissipation.

When informed by open fault detection circuit 140 about the light source module 11 with an open fault, microcontroller 110 temporarily controls DC power supply 100 to reduce the output voltage, and then controls FET driver driving circuit 130 to supply current to the LED of FET driver 160. When the current is supplied to the LED of FET driver 160, the photocell of FET driver 160 is charged, and a voltage is applied to the gate of n-channel FET 170. This results in turning on n-channel FET 170 of the light source module 11 with the open fault.

When turned on, n-channel FET 170 is supplied with current, and a decreasing voltage is applied to the LED of photo-coupler 180 to turn off photo-coupler 180. When photo-coupler 180 is turned off, open fault detection circuit 140 supplies a high-level signal to AND circuit 150. This resumes the PWM control of n-channel FET 250. After this, microcontroller 110 controls DC power supply 100 so that the output voltage is increased, and again supplies current to light source modules 11. In this case, current flows through FET n-channel 170 in the light source module 11 with the open fault. As a result, current is supplied again to the light source modules 11 with no open fault by diverting the semiconductor light source 221 with the open fault.

The light source module 11 with an open fault can be identified in a short time as described above, so that current can be supplied in a minimum time again to the remaining light source modules 11 with no open fault. After this, microcontroller 110 stores the information to identify the light source module 11 with the open fault to memory 120.

When semiconductor light source driving apparatus 10 is started again to drive light source modules 11, n-channel FET 170 of the light source module 11 with the open fault can be turned on according to the data previously stored in memory 120. This allows the other light source modules 11 to remain lit.

According to the present exemplary embodiment, semiconductor light source driving apparatus 10 turns on n-channel FET 170 of the light source module 11 with an open fault if the open fault occurs, and then gradually increases the output voltage of DC power supply 100, while making current detection circuit 230 monitor the current flowing through light source modules 11. This can avoid the phenomenon that as soon as n-channel FET 170 is turned on, overcurrent flows through the light source modules 11 that are under normal conditions. This phenomenon occurs in the case that n-channel FET 170 is turned on after the output voltage of DC power supply 100 is raised.

According to the present exemplary embodiment, if an open fault occurs, the semiconductor light source 221 with the open fault is short-circuited by n-channel FET 170, so that the voltage drop can be very small in the unlit light source module 11 with the open fault. It is possible to use, as DC power supply 100, a power supply whose input power is approximately proportional to its output power, such as a switching power source. In this case, DC power supply 100 is only required to supply power almost only to light source modules 11 that can light up. This results in a reduction in the unwanted power consumption in the light source module which is unlit due to the open fault as observed in the conventional semiconductor light source driving apparatuses.

In the present exemplary embodiment, semiconductor light source 221 used in each light source module 11 is composed of serially-connected laser diodes 220, but may alternatively be composed of a single laser diode 220. In that case, if the single laser diode 220 has an open fault, semiconductor light source 221 composed of this laser diode 220 with the open fault can be made unlit by being short circuited by n-channel FET 170, and the other laser diodes 220 can remain lit.

[1-3] Effects

As described above, semiconductor light source driving apparatus 10 of the present exemplary embodiment includes light source modules 11 each including the following: semiconductor light source 221 composed of serially-connected laser diodes 220, n-channel FET 170, FET driver 160, constant voltage diode 210 for voltage suppression, constant voltage diode 190 for voltage detection, resistor 200, and photo-coupler 180 for transmission of fault detection information. In order to control the illumination of light source modules 11, semiconductor light source driving apparatus 10 further includes the following: current detection resistor 240, current detection circuit 230, n-channel FET 250, DC power supply 100, FET driver driving circuit 130, open fault detection circuit 140, AND circuit 150, memory 120, and microcontroller 110.

With this configuration, if an open fault occurs in any of semiconductor light sources 221, semiconductor light source driving apparatus 10 can form a current bypass path in n-channel FET 170 connected in parallel with the semiconductor light source 221 with the open fault, allowing the other serially-connected semiconductor light sources 221 to remain supplied with current.

Constant voltage diode 210 for voltage suppression is inserted in parallel with n-channel FET 170, and the voltage generated in n-channel FET 170 at the occurrence of an open fault is limited by the breakdown voltage of constant voltage diode 210. This allows the use of n-channel FET 170 with a low withstand voltage, thereby reducing the cost and the on-resistance of n-channel FET 170 and hence power dissipation.

If an open fault occurs in any of semiconductor light sources 221, semiconductor light source driving apparatus 10 makes constant voltage diode 190, resistor 200, and photo-coupler 180 detect the voltage generated in n-channel FET 170. semiconductor light source driving apparatus 10 then makes open fault detection circuit 140 connected to the phototransistors of the plurality of photo-couplers 180 identify which of the semiconductor light sources 221 has an open fault. Semiconductor light source driving apparatus 10 then turns on the n-channel FET 170 connected in parallel with the semiconductor light source 221 with the open fault, so that the other semiconductor light sources 221 with no open faults can be supplied with current in a minimum time.

Semiconductor light source driving apparatus 10 stores the information to identify the semiconductor light source 221 with the open fault to memory 120. When started, semiconductor light source driving apparatus 10 soon turns on the n-channel FET 170 that is inserted in parallel with the semiconductor light source 221 with the open fault to memory 120, thereby increasing the speed of the subsequent start-up.

With this configuration, semiconductor light source driving apparatus 10 allows n-channel FET 170 to short circuit the semiconductor light source 221 that cannot be lit due to the open fault and diverts this semiconductor light source 221, thereby reducing unwanted power consumption.

According to the present exemplary embodiment, if an open fault occurs in any of semiconductor light sources 221, semiconductor light source driving apparatus 10 makes open fault detection circuit 140 send a low-level signal to AND circuit 150, thereby turning off n-channel FET 250. This can cut off the current flowing through constant voltage diode 210 in a short time. Hence, a constant voltage diode with low rated power consumption can be used as constant voltage diode 210.

Second Exemplary Embodiment

A second exemplary embodiment will now be described with reference to FIG. 2.

[2-1] Configuration

First, semiconductor light source driving apparatus 20 of the second exemplary embodiment will now be described with reference to the block diagram of FIG. 2. In the present exemplary embodiment, like components are labeled with like reference numerals with respect to the first exemplary embodiment for convenience of explanation.

Semiconductor light source driving apparatus 20 includes DC power supply 100, microcontroller 110, memory 120, photo-coupler driving circuit 310, open fault detection circuit 140, AND circuit 150, a plurality of light source modules 21, current detection circuit 230, n-channel FET 250, current detection resistor 240, resistor 260, floating power supply 320, and grounded power supply 330.

N-channel FET 250, which on-off controls the current flowing through light source modules 21, is connected in series with light source modules 21 together with current detection resistor 240.

The voltage generated across current detection resistor 240 is supplied to current detection circuit 230, which in turn supplies its detection output to microcontroller 110. The connection point of current detection resistor 240 and light source modules 21 is grounded.

AND circuit 150 computes the AND of an incoming PWM signal with a signal from open fault detection circuit 140, and supplies its output to the gate of n-channel FET 250. The signal supplied from open fault detection circuit 140 to AND circuit 150 is a low-level signal in the case of an open fault and is a high-level signal in the normal condition.

DC power supply 100 supplies a DC voltage across the serial connection of light source modules 21, n-channel FET 250, and current detection resistor 240. The output DC voltage is controlled by microcontroller 110.

Memory 120 stores information to identify which of light source modules 21 has/have an open fault, if any.

Each light source module 21 includes semiconductor light source 221 composed of one or a predetermined number of serially-connected laser diodes 220. Semiconductor light source 221 is connected in parallel with constant voltage diode 210 for voltage suppression. Semiconductor light source 221 is further connected in parallel with a circuit composed of constant voltage diode 190 for voltage detection, resistor 200, and the LED of photo-coupler 180, all of which are connected in series. Semiconductor light source 221 is further connected in parallel with the drain and source of n-channel FET 170.

The output of the phototransistor of photo-coupler 180 is supplied to open fault detection circuit 140.

Resistor 300 is connected between the gate and the source of n-channel FET 170. One end of resistor 300 is connected to the connection point of the emitter of the phototransistor of photo-coupler 270 and the gate of n-channel FET 170, and the other end is connected to the source of n-channel FET 170. Photo-coupler 270 is used to drive the FET.

Capacitor 290 and constant voltage diode 340 are connected in parallel between the collector of the phototransistor of photo-coupler 270 and the other end of resistor 300 connected to the source of n-channel FET 170.

The anode of the LED of photo-coupler 270 is connected via resistor 260 to photo-coupler driving circuit 310, whereas the cathode is connected directly to photo-coupler driving circuit 310.

Floating power supply 320 is connected to the plurality of light source modules 21 that are connected between the positive electrode (+) of DC power supply 100 and the drain of n-channel FET 250. The positive electrode of floating power supply 320 is connected to the collector of the phototransistor of photo-coupler 270 via resistor 280, whereas the negative electrode of floating power supply 320 is connected to the positive electrode of DC power supply 100.

Grounded power supply 330 is connected to the plurality of light source modules 21 that are connected between the negative electrode (−) of DC power supply 100 and the source of n-channel FET 250. The positive electrode of grounded power supply 330 is connected to the collector of the phototransistor of photo-coupler 270 via resistor 280, whereas the negative electrode of grounded power supply 330 is grounded.

[2-2] Operation

The operation of semiconductor light source driving apparatus 20 with the above structure will now be described with reference to FIG. 2.

In semiconductor light source driving apparatus 20 of the second exemplary embodiment, FET driver 160 of semiconductor light source driving apparatus 10 of the first exemplary embodiment has been replaced with resistors 260, 280, 300, photo-coupler 270, capacitor 290, constant voltage diode 340, floating power supply 320, and grounded power supply 330. The components common to semiconductor light source driving apparatuses 10 and 20 of the first and second exemplary embodiments, respectively, perform the same operation. Therefore, the following description will be focused on the components of the second exemplary embodiment that are different from those of the first exemplary embodiment.

If an open fault occurs in any of light source modules 21, the voltage across the light source module 21 with the open fault increases to the breakdown voltage of constant voltage diode 210 for voltage suppression. When the voltage of constant voltage diode 210 increases, current flows through the LED of photo-coupler 180. As a result, the phototransistor of photo-coupler 180 is turned on, which is detected by open fault detection circuit 140. Open fault detection circuit 140 informs microcontroller 110 of this light source module 21 with the open fault. When informed by open fault detection circuit 140, microcontroller 110 temporarily controls DC power supply 100 so that the output voltage is reduced, and then control photo-coupler driving circuit 310 so that current is supplied to the LED of photo-coupler 270 in the light source module 21 with the open fault.

Figure 2:
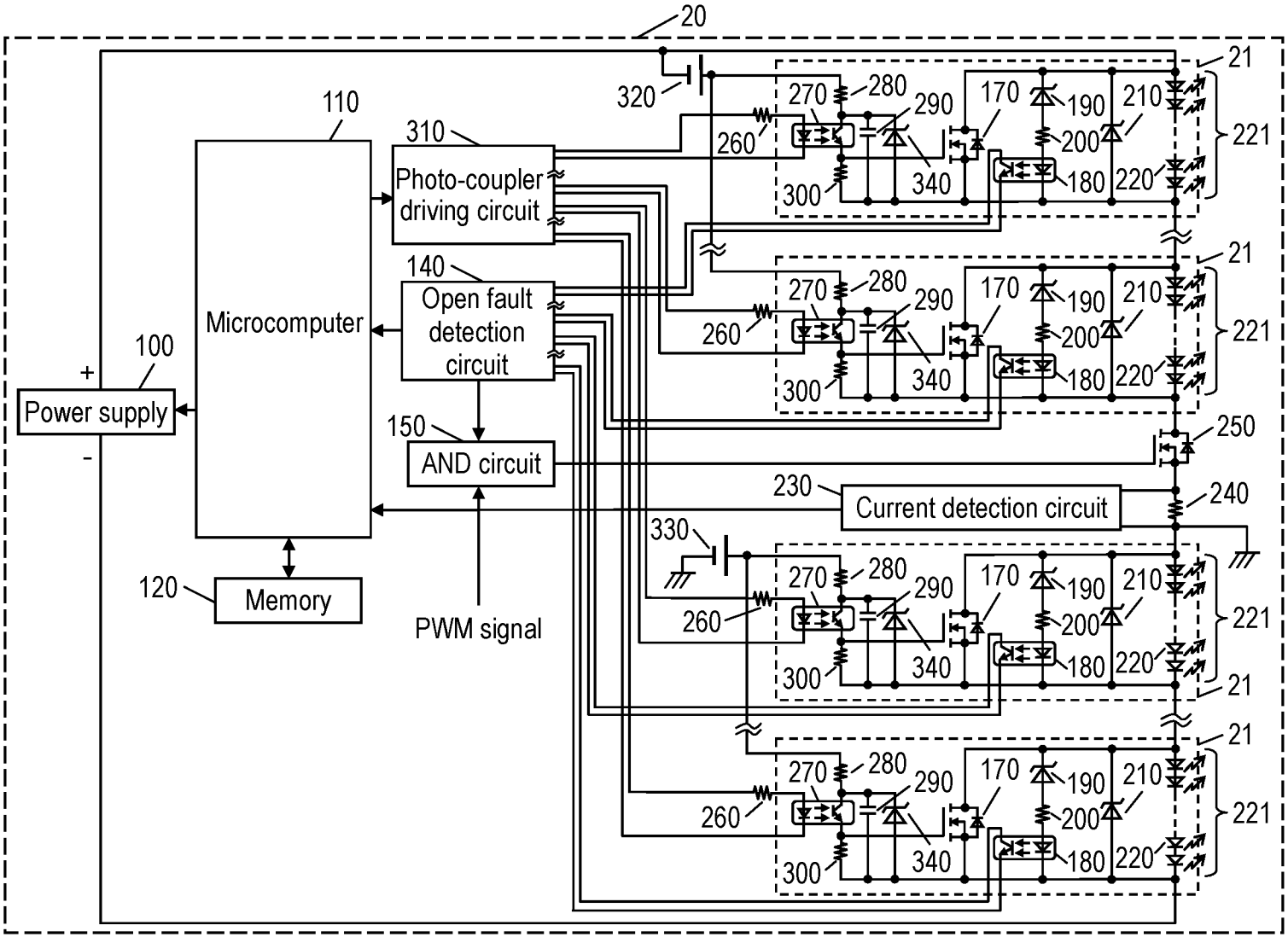
FIG. 2 is a circuit block diagram of a semiconductor light source driving apparatus according to a second exemplary embodiment.

In FIG. 2, the negative electrode of floating power supply 320 is connected to the positive electrode of DC power supply 100. Therefore, the positive electrode of floating power supply 320 has a potential higher by the voltage of floating power supply 320 than the potentials of all parts of the circuit connected to DC power supply 100. This potential difference allows capacitor 290 to be supplied with current through resistor 280 connected with the positive electrode of floating power supply 320 in the light source modules 21 connected between the positive electrode of DC power supply 100 and n-channel FET 250. The potential difference across capacitor 290 increases to the breakdown voltage of constant voltage diode 340. If the LED of photo-coupler 270 is supplied with current when capacitor 290 is charged, the phototransistor of photo-coupler 270 is turned on. As a result, a voltage is applied to the gate of n-channel FET 170, so that n-channel FET 170 is turned on.

In FIG. 2, in the light source modules 21 connected between current detection resistor 240 and the negative electrode of DC power supply 100, grounded power supply 330 is provided instead of floating power supply 320. Grounded power supply 330 supplies current to capacitor 290 via resistor 280, and the potential difference across capacitor 290 increases to the breakdown voltage of constant voltage diode 340. In the case that the LED of photo-coupler 270 is supplied with current when capacitor 290 is in the charged state, the phototransistor of photo-coupler 270 is turned on. As a result, a voltage is applied to the gate of n-channel FET 170, so that n-channel FET 170 is turned on. Using another floating power supply 320 instead of grounded power supply 330 would provide the same operation, but using grounded power supply 330 has the effect of reducing the load of the floating power supply 320.

As described above, the circuit including photo-coupler 270, capacitor 290, constant voltage diode 340, floating power supplies 320, grounded power supply 330, and resistors 260, 280, 300 turns on n-channel FET 170 in the same manner as does FET driver 160 composed of the integrated combination of the LED and the photocell used in the first exemplary embodiment.

In the light source module 21 with the open fault, n-channel FET 170 is turned on and supplied with current. As a result, current is supplied to the other light source modules 21 with no open faults by diverting semiconductor light source 221 with the open fault.

[2-3] Effects

The present exemplary embodiment provides advantages similar to those described in the first exemplary embodiment. The present exemplary embodiment also provides an inexpensive structure to short circuit n-channel FET 170 of light source modules 21 with an open fault without using FET driver 160 composed of the integrated combination of the LED and the photocell used in the first exemplary embodiment.

Other Exemplary Embodiments

The first and second exemplary embodiments have been described as technical examples of the present application, and the techniques of the present disclosure are not limited to them and are applicable to other exemplary embodiments provided with modification, replacement, addition, omission, etc. It would also be possible to provide additional exemplary embodiments by combining some of the components used in the first and second exemplary embodiments.

In the first and second exemplary embodiments, a combination of current detection resistor 240 and current detection circuit 230 is used as an example of current detection means. The current detection means, which only needs to detect current, is not limited to this combination; however, this combination can be achieved at low cost. The current detection means can alternatively be a Hall sensor, which can prevent power dissipation due to current detection resistor 240.

The above-described exemplary embodiments exemplify the techniques of the present disclosure. Therefore, various modification, replacement, addition, and omission can be made within the range of the claims and their equivalents.

INDUSTRIAL APPLICABILITY

The semiconductor light source driving apparatus of the present disclosure can be used to drive semiconductor light sources such as projection image display apparatuses.

What is claimed is:

1. A semiconductor light source driving apparatus comprising:

a plurality of light source modules each including the following components connected in parallel:

a semiconductor light source composed of one or more serially-connected semiconductor light source elements;

a first constant-voltage diode;

a series circuit of a first current detection element and a second constant-voltage diode with a lower breakdown voltage than the first constant-voltage diode; and a switching element, a current control element controlled by pulse-width modulation (PWM) using a PWM signal supplied to an end of the current control element;

a second current detection element for detecting current flowing through the light source modules;

a direct current (DC) power supply for supplying a DC voltage across a serial connection of the light source modules, the current control element, and the second current detection element; and a controller for controlling the switching element, the current control element, and the DC power supply, wherein the controller controls an output voltage of the DC power supply based on a detection output of the second current detection element; and after the first current detection element generates a detection output in response to an occurrence of an open fault in any of the semiconductor light sources, and then the current control element is turned off based on the detection output of the first current detection element, the controller turns on the switching element of the light source module including the semiconductor light source with the open fault, thereby allowing the current control element to be controlled by the PWM.

2. The semiconductor light source driving apparatus of claim 1, wherein the first current detection element is composed of a first photo-coupler, and the second constant-voltage diode forms the series circuit together with a light emitting diode of the first photo-coupler.

3. The semiconductor light source driving apparatus of claim 1, wherein the light source modules each further include a field-effect transistor (FET) driver including a light emitting diode and a photocell, and the FET driver drives the switching element under control of the controller.

4. The semiconductor light source driving apparatus of claim 1, further comprising a floating power supply, wherein the switching element is a first FET, and the light source modules each further include:

a second photo-coupler including a phototransistor whose emitter is connected to a gate and a source of the first FET; and a capacitor and a third constant-voltage diode connected in parallel between a collector of the phototransistor of the second photo-coupler and the source of the first FET, wherein a negative electrode of the floating power supply is connected to a positive electrode of the DC power supply and a positive electrode of the floating power supply is connected to the collector of the phototransistor of the second photo-coupler; and the controller controls the second photo-coupler so that the first FET is controlled.

5. The semiconductor light source driving apparatus of claim 4, further comprising a grounded power supply whose negative electrode is grounded, wherein at least one of the light source modules is connected between the second current detection element and the positive electrode of the DC power supply, and remaining at least one light source module is connected between the second current detection element and a negative electrode of the DC power supply, the positive electrode of the floating power supply is connected to the collector of the phototransistor of the second photo-coupler of each of the at least one light source module connected to the positive electrode of the DC power supply, and a positive electrode of the grounded power supply is connected to the collector of the phototransistor of the second photo-coupler of each of the remaining at least one light source module connected to the negative electrode of the DC power supply.

* * * * *